US005702273A

United States Patent [19]

Cho et al.

[11] Patent Number: 5,702,273

[45] Date of Patent: Dec. 30, 1997

[54] MARINE PROPULSION SYSTEM FOR UNDERWATER VEHICLES

[75] Inventors: Chahee Peter Cho; William P. Krol, Jr., both of Portsmouth, R.I.

[73] Assignee: The United States of America as represented by the Secretary of the Navy, Washington, D.C.

[21] Appl. No.: 649,971

[22] Filed: May 19, 1996

[51] Int. Cl.[6] ..... B63H 21/17

[52] U.S. Cl. ..... 440/6; 114/337; 310/87

[58] Field of Search ..... 410/6, 38; 310/87; 114/20.2, 337, 338

[56] References Cited

U.S. PATENT DOCUMENTS 5,078,628 1/1992 Garis, Jr. ..... 440/6

5,252,875 10/1993 Veronesi et al. ..... 440/6

*Primary Examiner*—Sherman Basinger

*Attorney, Agent, or Firm*—Michael J. McGowan; Michael F. Oglo; Prithvi C. Lall

[57] ABSTRACT

A marine propulsion system for underwater vehicles includes motor inner stator assemblies disposed in hull portions of the vehicle, fixed blades extending outwardly from an after one of the hull portions, a shroud fixed to outer ends of the fixed blades and encircling the hull portions, and a motor outer stator assembly disposed in the shroud. A rotor hub is disposed in an annular recess formed by the hull portions, the hub having permanent magnets therein adjacent the motor inner stator assemblies, and has rotor blades mounted thereon and extending outwardly therefrom and being at least in part of a permanent magnet material, outer ends of the rotor blades being adjacent the motor outer stator assembly. Activation of the stator assemblies by a polyphase A.C. power source induces movement in the permanent magnets and rotor blades to cause the rotor hub and blades to rotate. The rotation of the rotor blades serves to provide propulsive thrust to the vehicle.

5 Claims, 6 Drawing Sheets

MARINE PROPULSION SYSTEM FOR UNDERWATER VEHICLES

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to marine propulsion systems and is directed more particularly to a propulsion system for an underwater vehicle.

(2) Description of the Prior Art

Traditional electrically powered marine propulsion systems generally include (1) an energy source, such as a battery or AC generator, (2) a power conversion means for converting the current output of the energy source, (3) an electric motor, (4) a coupling system for transferring the motor output, which coupling system usually includes shafts, bearings and linkages, (5) a propulsor for imparting thrust to the vehicle, and (6) a cooling system for removing waste heat from the assembly. The cooling system typically includes a circulation pump, a heat exchanger and piping. Inasmuch as space is at a premium in underwater vehicles, there is a need to eliminate as many propulsion components as possible.

Further, proper alignment of the motor, coupling system and propulsor must be maintained. Otherwise, vibrations result which, in turn, cause noise and wear. In military applications, noise can lead to early detection and interception, resulting in failed missions.

Still further, in traditional systems the fairing of the stern portion of a marine vehicle places severe restrictions on the diameter of the motor. The efficiency of a permanent magnet, brushless electric motor varies in direct relationship to the number and length of permanent magnet poles. That is, increasing the number and/or length of magnet poles increases efficiency, power density, and output torque. However, because of the limited space available, the magnet poles necessarily are limited in number and dimension. There is a need to increase output torque such that the propulsor can rotate at a lower speed and operate more efficiently and more quietly.

SUMMARY OF THE INVENTION

It is, therefore, an object of the invention to provide a marine propulsion system for underwater vehicles, wherein the system comprises fewer components, operates more efficiently and quietly, and in which alignment of components is not a problem.

With the above and other objects in view, as will hereinafter appear, a feature of the present invention is the provision of a marine propulsion system for underwater vehicles, the propulsion system comprising motor inner stator assemblies disposed in hull portions of the vehicle, fixed blades extending outwardly from an after hull portion, a shroud fixed to outer ends of the fixed blades and encircling the hull portions, and a motor outer stator assembly disposed in the shroud. A rotor hub is disposed in an annular formed by the hull portions, the hub having permanent magnet assemblies therein adjacent the motor inner stator assemblies, and having blades mounted thereon and extending outwardly therefrom and comprising permanent magnets, outer ends of the rotor blades being adjacent the motor outer stator assembly. Activation of the stator assemblies, preferably by polyphase A.C. excitation, induces movement in the permanent magnet assemblies and rotor blades to cause the rotor hub and rotor blades to rotate. Rotation of the rotor blades serves to provide propulsive thrust to the vehicle.

In accordance with a further feature of the invention, there is provided a marine propulsion system for underwater vehicles, the propulsion system comprising a stern hull portion of the vehicle, a rigid tube extending from an after surface of the stern hull portion, and an after hull portion fixed to the tube, the tube and the after hull portion being immovable relative to the stern hull portion, the after hull portion being spaced from the stern hull portion to define therebetween an annular recess. A motor forward stator assembly is disposed in an after surface of the stern hull portion and defines a forward wall of the recess. A motor after stator assembly is disposed in a forward surface of the after hull portion and defines an after wall of the recess. Stator blades are fixed to the after hull portion and extend outwardly therefrom. A shroud is fixed to outer ends of the stator blades and encircles the recess. A motor outer stator assembly is disposed in the shroud. A rotor hub is disposed in the recess and is rotatable on the tube. Permanent magnet assemblies are disposed in the rotor hub and are adjacent, respectively, the motor forward stator assembly and the motor after stator assembly. Rotor blades comprising permanent magnets are fixed to and extend outwardly from the rotor hub, the rotor blades having outer ends adjacent the motor outer stator assembly. Electrical conductors extend from a power source in the hull to the motor forward, after, and outer stator assemblies. Electrical current from the power source is conducted by electrical conductors to the stator assemblies to cause the permanent magnet assemblies of the rotor hub and the rotor blades to move, to cause the rotor assembly to rotate on the tube. Rotation of the rotor blades serves to provide propulsive thrust to the vehicle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 2:
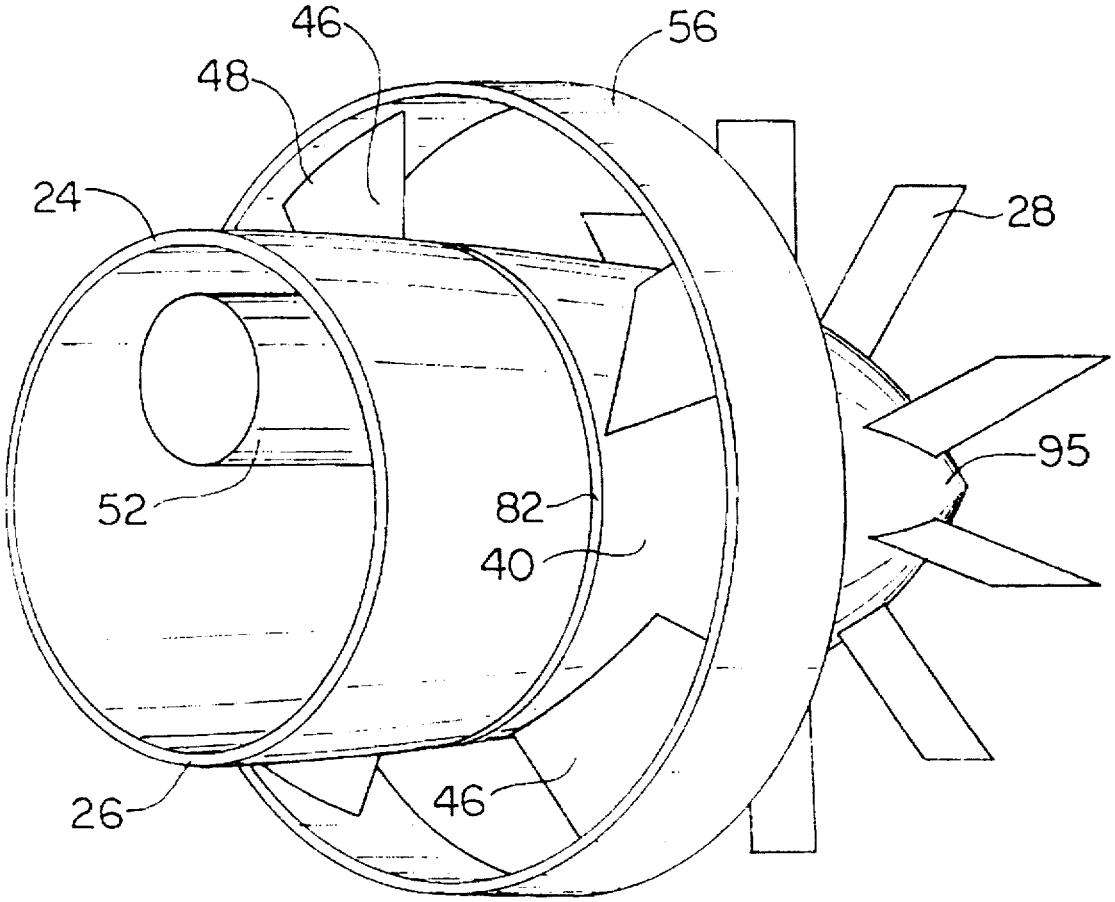
FIG. 2 is similar to FIG. 1, but with shroud portions removed revealing portions of the structure not seen in FIG. 1.
Figure 3:
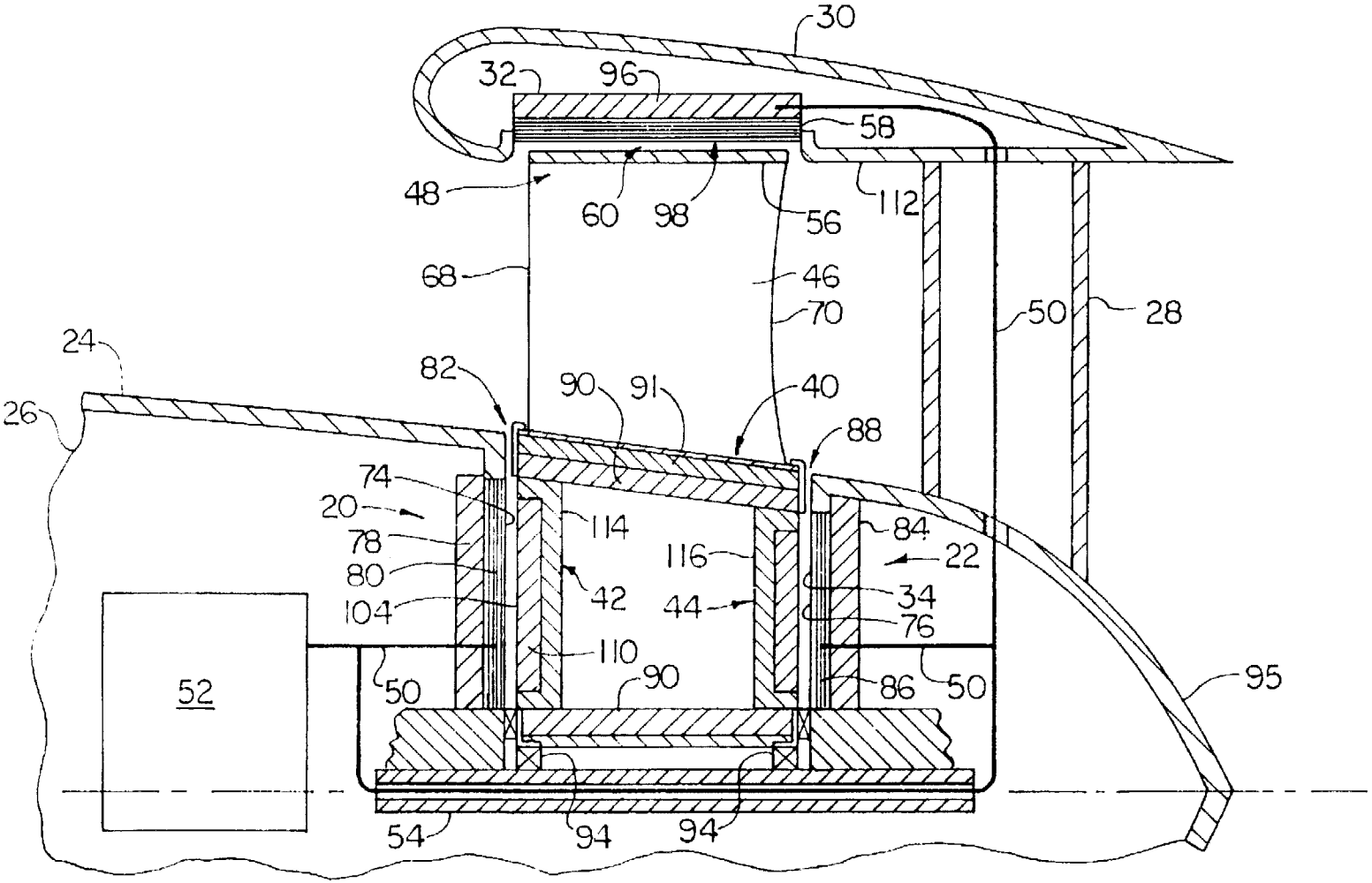
FIG. 3 is a sectional view of substantially an upper half of the propulsion system.

Referring to FIG. 3, it will be seen that the illustrative marine propulsion system for underwater vehicles includes a motor forward inner stator assembly 20 and a motor after inner stator assembly 22 in a stern hull portion 24 of an underwater vehicle 26. Fixed stator blades 28 extend outwardly from hull portion 24 (FIGS. 2 and 3). A shroud 30 (FIGS. 1 and 3) is fixed to outer ends of fixed stator blades 28 and encircles hull portion 24. A motor outer stator assembly 32 is disposed in shroud 30.

A rotor hub 40 is disposed in an annular recess 34 in hull portion 24. Mounted in hub 40 are forward and after permanent magnet assemblies 42, 44, respectively adjacent motor forward and after inner stator assemblies 20, 22. Rotor blades 46 comprising at least in part permanent magnet material, extend outwardly from rotor hub 40. Outer ends 48 of rotor blades 46 are adjacent motor outer stator assembly 32.

Referring still to FIG. 3, it will be seen that fixed stator blades 28 are hollow, and that shroud 30 is hollow, and that electrical conductor means 50 extend from a polyphase A.C. power source 52, preferably a three phase A.C. source, in hull portion 24, to forward inner stator assembly 20, and through a rigid tube 54 to after inner stator assembly 22, and through hollow stator blades 28 and hollow shroud 30 to outer stator assembly 32.

Preferably, a circular band 56 is fixed to outer ends 48 of rotor blades 46 (FIGS. 1–4), band 56 being adjacent a windings portion 58 of outer stator assembly 32 and defining therebetween a gap 60.

Figure 4:
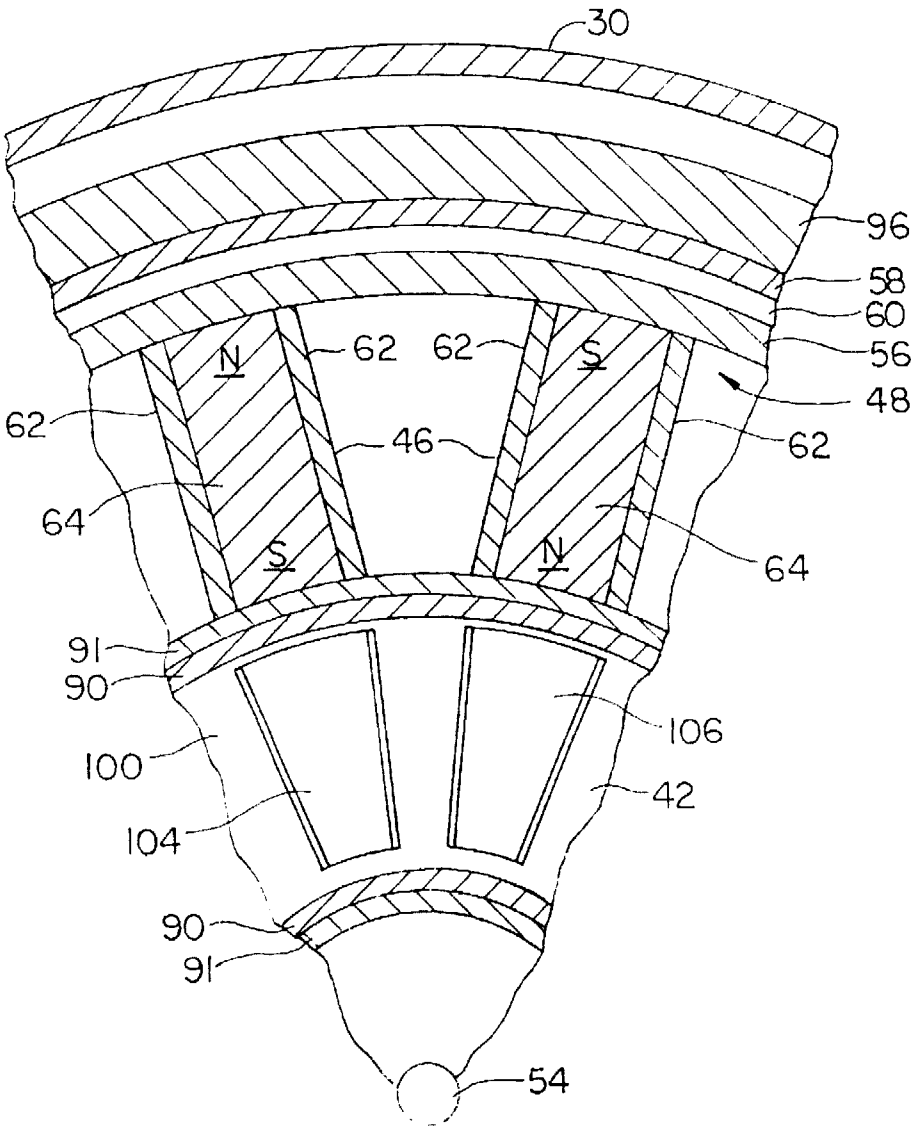
FIG. 4 is a partial sectional view normal to the section of FIG. 3.
Figure 5:
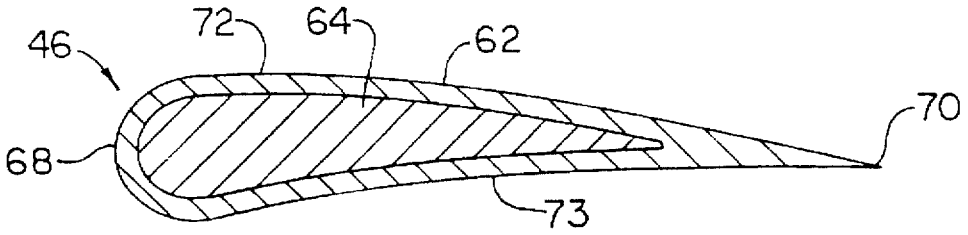
FIG. 5 is a sectional view through one rotor blade.
Figure 5A:
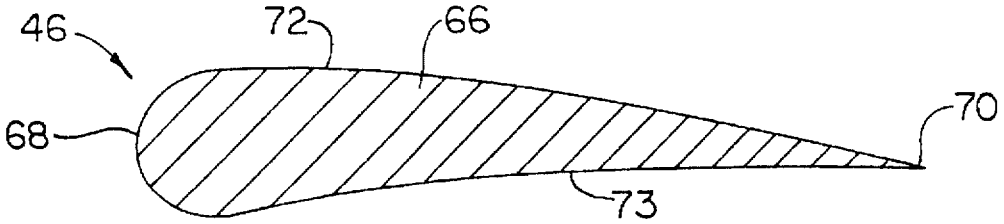
FIG. 5A is similar to FIG. 5, but shows an alternative embodiment of rotor blade.

As shown in FIGS. 4 and 5, rotor blades 46 may be hollow with walls 62 formed of a rigid metal, such as steel, and the hollow interior filled with a permanent magnet material 64, such as powdered iron, or the like. Alternatively, as shown in FIG. 5A, each rotor blade 46 may constitute a rigid discrete permanent magnet 66, of magnetized iron, or the like. The rotor blades 46 are polarized such that the outer ends 48 thereof alternate in polarity, as shown in FIG. 4.

Referring to FIGS. 5 and 5A, it will be seen that rotor blades 46 are of a turbine blade configuration in fore-and-aft section, and include a rounded leading edge 68, a tapered trailing edge 70, a generally convex suction side 72, and a generally concave pressure side 73.

Figure 1:
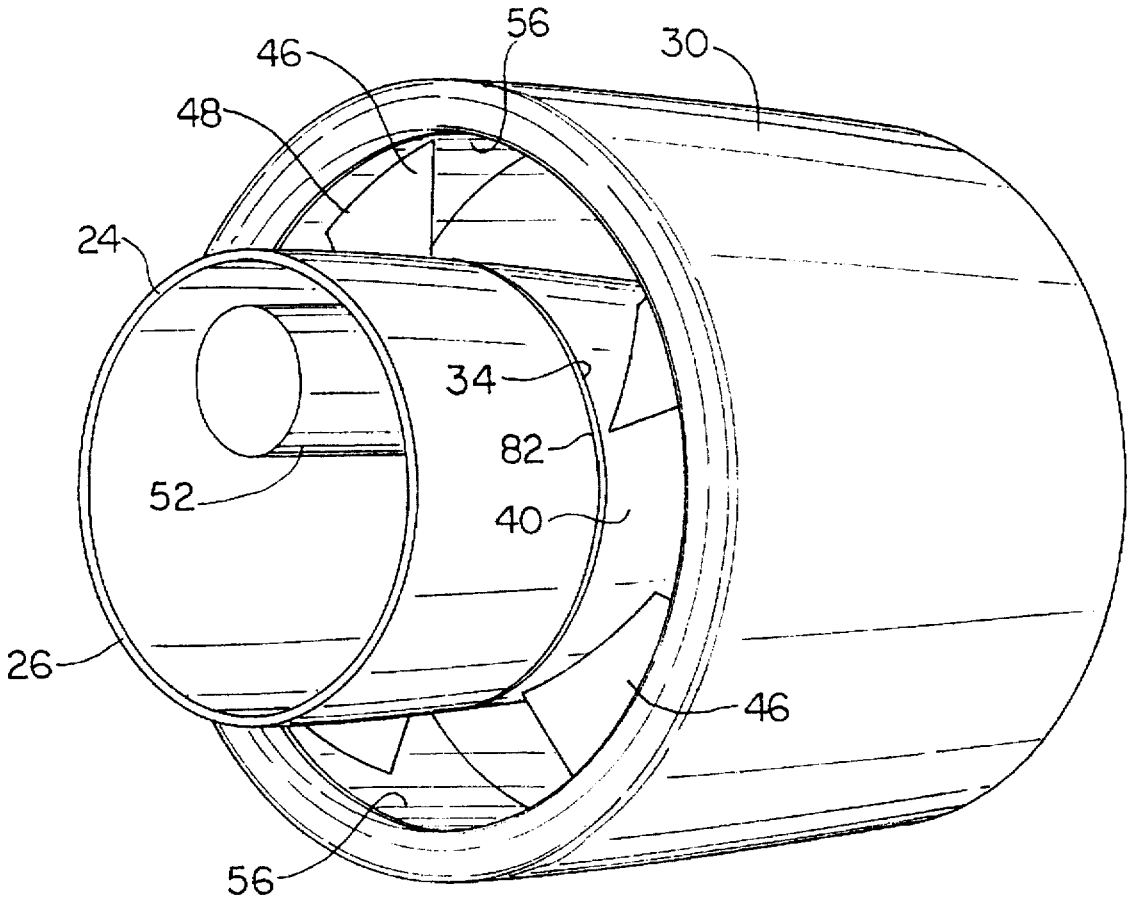
FIG. 1 is a perspective view of portions of a propulsion system, illustrative of an embodiment of the invention.

As illustrated in FIGS. 1 and 3, shroud 30 in fore-and-aft section is of a hydrofoil configuration throughout its extent which, as noted above, encircles vehicle 26.

Forward inner stator assembly 20 forms at least in part a forward wall 74 of recess 34 (FIG. 3), and after inner stator assembly 22 forms at least in part an after wall 76 of recess 34. Forward inner stator assembly 20 includes a forward backing iron 78 and a forward winding assembly 80, the latter being spaced from forward permanent magnet assembly 42 to define forward gap 82 therebetween. Similarly, after inner stator assembly 22 includes an after backing iron 84 and an after winding assembly 86, the latter spaced from after permanent magnet assembly 44 to define after gap 88.

Forward and after inner stator assemblies 20, 22 are interconnected by a rotor hub inner cylinder 90 over which is disposed rotor hub outer cylinder 91, which together form rotor hub 40, rotor blades 46 being fixed to outer cylinder 91 which, in turn, is fixed to inner cylinder 90. Rotor blades 46 may be formed integrally with outer cylinder 91.

Hub 40 is annularly shaped and is rotatably mounted on tube 54, as by bearings 94. Fixed to an after end of tube 54 is an after hull portion, or fairwater, 95. Hull portions 24 and 95 form therebetween recess 34. The inner stator assembly 20 is disposed in hull portion 24 and the after inner stator assembly 22 is disposed in hull portion 95 (FIG. 3).

Outer stator assembly 32 includes outer windings 58 and an outer back iron 96, windings 58 forming the bottom of a recess 98 in an inside surface 112 of shroud 30, recess 98 receiving circular band 56 and rotor blade outer ends 48.

Figure 6:
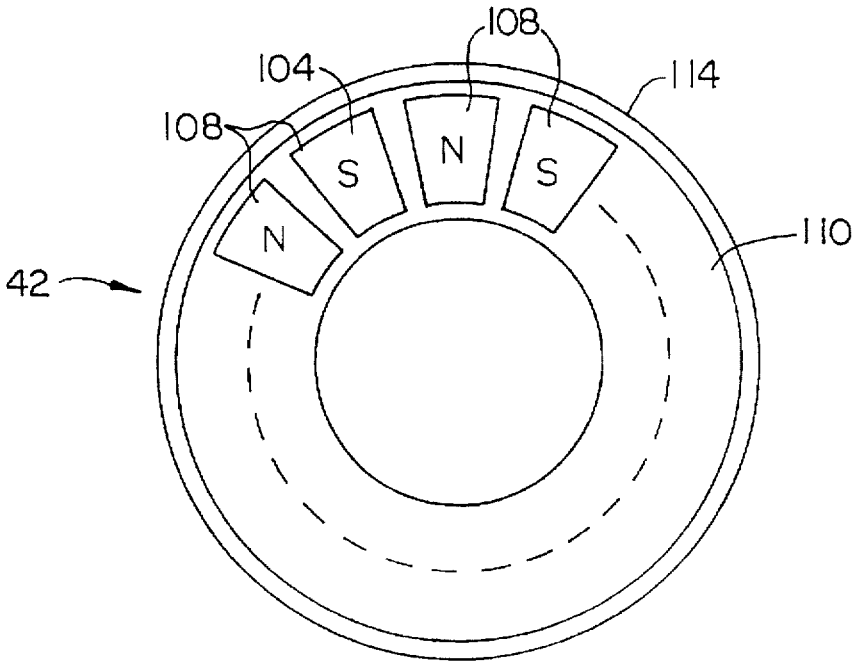
FIG. 6 is a front elevational view of a rotor permanent magnet assembly.
Figure 7:
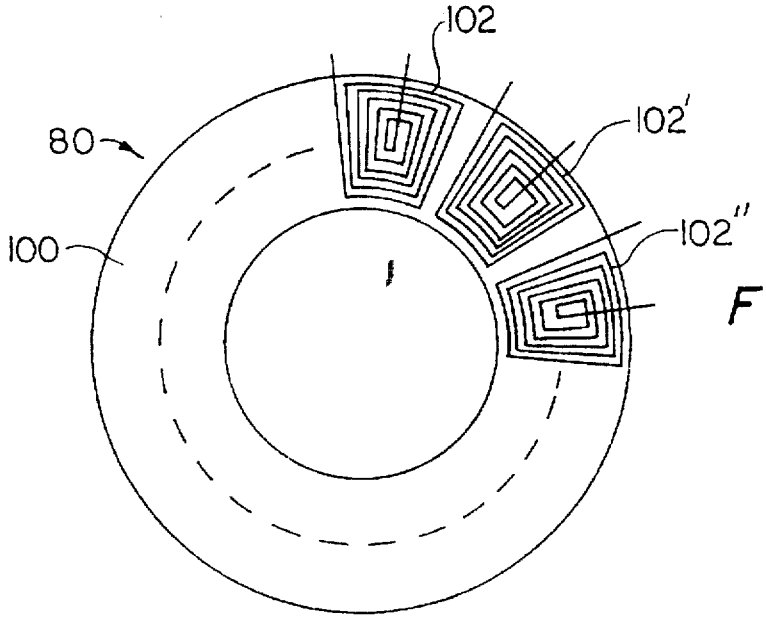
FIG. 7 is a front elevational view of a stator windings assembly.
Figure 8:
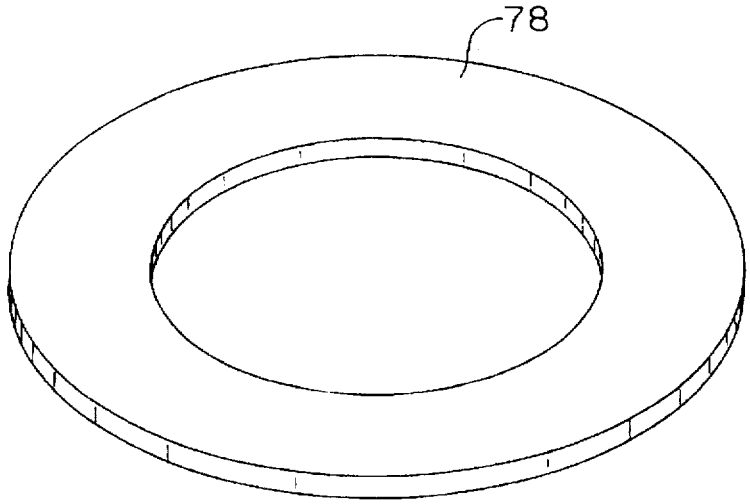
FIG. 8 is a perspective view of a stator inner backing iron.
Figure 9:
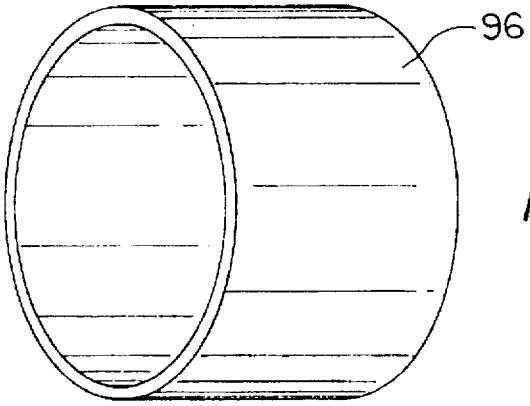
FIG. 9 is a perspective view of the stator outer backing iron.

Forward winding assembly 80 (FIG. 7) comprises a ring 100 having thereon a series of windings 102, all in electrical communication with conductor means 50 (FIG. 3). After winding assembly 86 similarly comprises a ring having thereon a series of windings, all in electrical communication with conductor means 50. In FIG. 7, there is illustrated forward winding assembly 80. After winding assembly 86 is substantially of the same configuration, size and structure as forward winding assembly 80. The windings 102, 102' and 102" of both the forward and after winding assemblies 80, 86 are respectively disposed substantially parallel to opposing surfaces 104 of forward permanent magnet assembly magnets 108 and after permanent magnet assembly magnets. Preferably, the windings are in sets of three to receive polyphase excitation from the polyphase A.C. source 52. In FIGS. 3 and 6, there is shown forward permanent magnet assembly 42 comprising a ring 110 having therein magnets 108 of alternating polarity, and a rotor backing iron 114. Similarly, the after permanent magnet assembly 44 comprises a ring having therein magnets of alternating polarity, virtually identical to that shown in FIG. 6, and a rotor backing iron 116. The stator outer windings portion 58 is provided with windings which are concentric with circular band 56.

In operation, the application of typically three-phase A.C. electrical current to conductor means 50 serves to activate forward and after windings 102 and outer windings 58, which act upon permanent magnet assemblies 42, 44 and permanent magnet rotor blades 46, to cause movement of the permanent magnets 108, and thereby rotative movement of the rotor hub 40. As rotor blades 46 turn through the annulus between hub 40 and shroud 30, water is forced therethrough, providing thrust to vehicle 26. Stator blades 28 are fixed aft of rotor blades 30 and serve to damp turbulence churned up by rotor blades 46.

There is thus provided a marine propulsion system having higher efficiency, power density and output torque than conventional systems, primarily due to the increased diameter of the rotor, which is not constrained to hull dimensions. There is further provided a propulsion system not requiring a cooling system for the motor, and therefore no circulation pump and attendant structure. The gaps 60, 82, and 88 permit flow of water between stator and rotor components, carrying away heat that otherwise would have to be removed by a cooling assembly. There is still further provided a system wherein there is no need for a coupling between motor and propulsor, and therefore no need for the usual attendant bearings and linkages. Thus, fewer components are required, reducing costs and potential sources of failure.

It is to be understood that the present invention is by no means limited to the particular construction herein disclosed and/or shown in the drawings, but also comprises any modifications or equivalents within the scope of the claims.

What is claimed is:

1. A marine propulsion system for underwater vehicles, said propulsion system comprising:

motor inner stator assemblies disposed in hull portions of said vehicle;

fixed stator blades extending outwardly from an after one of said hull portions wherein said fixed stator blades are hollow;

a shroud fixed to outer ends of said fixed stator blades and encircling said hull portions wherein said shroud is hollow;

a motor outer stator assembly disposed in said shroud;

a rotor hub disposed in an annular recess formed by said hull portions, said hub having permanent magnet assemblies therein respectively adjacent said motor inner stator assemblies, and having rotor blades mounted thereon and extending outwardly therefrom and comprising permanent magnets, outer ends of said rotor blades being adjacent said motor outer stator assembly; and electrical conductor means extending from a power source in one of said hull portions to said motor inner stator assemblies, and through said stator blades and said shroud to said motor outer stator assembly;

whereby activation of said stator assemblies induces movement in said permanent magnet assemblies and said rotor blades to cause said rotor hub and rotor blades to rotate, said rotation of said rotor blades serving to provide propulsive thrust to said vehicle.

2. A marine propulsion system for underwater vehicles, said propulsion system comprising:

motor inner stator assemblies disposed in hull portions of said vehicle;

fixed stator blades extending outwardly from an after one of said hull portions wherein said fixed stator blades are hollow;

a shroud fixed to outer ends of said fixed stator blades and encircling said hull portions wherein said shroud is hollow;

a motor outer stator assembly disposed in said shroud; and a rotor hub disposed in an annular recess formed by said hull portions, said hub having permanent magnet assemblies therein respectively adjacent said motor inner stator assemblies, and having rotor blades mounted thereon and extending outwardly therefrom and comprising permanent magnets wherein said rotor blades are hollow and filled with permanent magnet material, outer ends of said rotor blades being adjacent said motor outer stator assembly;

whereby activation of said stator assemblies induces movement in said permanent magnet assemblies and said rotor blades to cause said rotor hub and rotor blades to rotate, said rotation of said rotor blades serving to provide propulsive thrust to said vehicle.

3. A marine propulsion system for underwater vehicles, said propulsion system comprising:

motor inner stator assemblies disposed in hull portions of said vehicle;

fixed stator blades extending outwardly from an after one of said hull portions;

a shroud fixed to outer ends of said fixed stator blades and encircling said hull portions;

a motor outer stator assembly disposed in said shroud; and a rotor hub disposed in an annular recess formed by said hull portions, said hub having permanent magnet assemblies therein respectively adjacent said motor inner stator assemblies, and having rotor blades mounted thereon and extending outwardly therefrom and comprising permanent magnets wherein each of said rotor blades is a discrete permanent magnet, outer ends of said rotor blades being adjacent said motor outer stator assembly;

whereby activation of said stator assemblies induces movement in said permanent magnet assemblies and said rotor blades to cause said rotor hub and rotor blades to rotate, said rotation of said rotor blades serving to provide propulsive thrust to said vehicle.

4. A marine propulsion system for underwater vehicles, said propulsion system comprising:

a first hull portion of the vehicle;

a rigid tube extending from an after surface of said first hull portion;

a second hull portion fixed to said tube, said tube and said second hull being immovable relative to said first hull portion, said second hull portion being spaced from said first hull portion to define therebetween an annular recess;

a motor forward stator assembly disposed in an after surface of said first hull portion and defining a forward wall of said recess;

a motor after stator assembly disposed in a forward surface of said second hull portion and defining an after wall of said recesses;

stator blades fixed to said second hull portion and extending outwardly therefrom;

a shroud fixed to outer ends of said stator blades and encircling said recess;

motor outer stator assemblies disposed in said shroud;

a rotor hub disposed in said recess and rotatable on said tube;

permanent magnets disposed in said rotor hub and adjacent, respectively, said motor forward stator assembly and said motor after stator assembly;

rotor blades comprising permanent magnets fixed to and extending outwardly from said rotor hub wherein said rotor blades are hollow and are filled with permanent magnet material, said rotor blades having outer ends adjacent said motor outer stator assemblies;

a circular band fixed to said outer ends of said rotor blades and disposed adjacent winding portions of said outer stator assemblies; and electrical conductors extending from a power source in said first hull portion to said motor forward, after, and outer stator assemblies;

whereby electrical current from said power source is conducted by said electrical conductors to said stator assemblies to cause said permanent magnets of said rotor hub and said rotor blades to move, to cause said rotor assembly to rotate on said tube, and wherein rotation of said rotor blades serves to provide propulsive thrust to said vehicle.

5. A marine propulsion system for underwater vehicles, said propulsion system comprising:

a first hull portion of the vehicle;

a rigid tube extending from an after surface of said first hull portion;

a second hull portion fixed to said tube, said tube and said second hull being immovable relative to said first hull portion, said second hull portion being spaced from said first hull portion to define therebetween an annular recess;

a motor forward stator assembly disposed in an after surface of said first hull portion and defining a forward wall of said recess;

a motor after stator assembly disposed in a forward surface of said second hull portion and defining an after wall of said recess;

stator blades fixed to said second hull portion and extending outwardly therefrom;

a shroud fixed to outer ends of said stator blades and encircling said recess;

motor outer stator assemblies disposed in said shroud;

a rotor hub disposed in said recess and rotatable on said tube;

permanent magnets disposed in said rotor hub and adjacent, respectively, said motor forward stator assembly and said motor after stator assembly;

rotor blades comprising permanent magnets fixed to and extending outwardly from said rotor hub wherein each of said rotor blades is a discrete permanent magnet, said rotor blades having outer ends adjacent said motor outer stator assemblies;

a circular band fixed to said outer ends of said rotor blades and disposed adjacent winding portions of said outer stator assemblies; and electrical conductors extending from a power source in said first hull portion to said motor forward, after, and outer stator assemblies;

whereby electrical current from said power source is conducted by said electrical conductors to said stator assemblies to cause said permanent magnets of said rotor hub and said rotor blades to move, to cause said rotor assembly to rotate on said tube, and wherein rotation of said rotor blades serves to provide propulsive thrust to said vehicle.

* * * * *